US005944468A

United States Patent [19]

McBrien

[11] Patent Number: 5,944,468

[45] Date of Patent: Aug. 31, 1999

[54] DEVICE FOR RAISING OBJECTS ABOVE ELEVATED WORK PLATFORMS

[75] Inventor: Declan McBrien, Floral Park, N.Y.

[73] Assignee: Declan T. McBrien, Floral Park, N.Y.

[21] Appl. No.: 09/073,864

[22] Filed: May 7, 1998

[51] Int. Cl.[6] ..... E04G 21/14

[52] U.S. Cl. ..... 414/11; 248/410

[58] Field of Search ..... 414/11; 248/354.1, 248/408, 410; 254/105

[56] References Cited

U.S. PATENT DOCUMENTS

| | | | |
|---|---|---|---|
| 2,832,479 | 4/1958 | Ottoway | 414/11 |
| 3,065,982 | 11/1962 | Dodd | 248/410 |
| 3,208,555 | 9/1965 | Fry | 414/11 |
| 4,375,934 | 3/1983 | Elliott | 414/11 |
| 4,560,031 | 12/1985 | Dixon et al. | 414/11 |
| 4,928,916 | 5/1990 | Molloy | 414/11 |

FOREIGN PATENT DOCUMENTS

| | | | |
|---|---|---|---|
| 2538437 | 6/1984 | France | 414/11 |

*Primary Examiner*—Janice L. Krizek
*Assistant Examiner*—Gregory A Morse

[57] ABSTRACT

Device for lifting objects such as building materials and supplies above the heads of workers on an elevated work station (scaffold or stepladder) has a clamp assembly for adjustably mounting the device on said work station, a vertical elongate tubular pipe carrying a horizontal load platform thereon, a pipe guide and a one-way pipe lock both secured to the clamp assembly and aligned with each other through which the elongate tubular pipe is pushed upwardly for the load platform to a desired height without slipping or downward motion until a manually operated lock release is pressed.

8 Claims, 2 Drawing Sheets

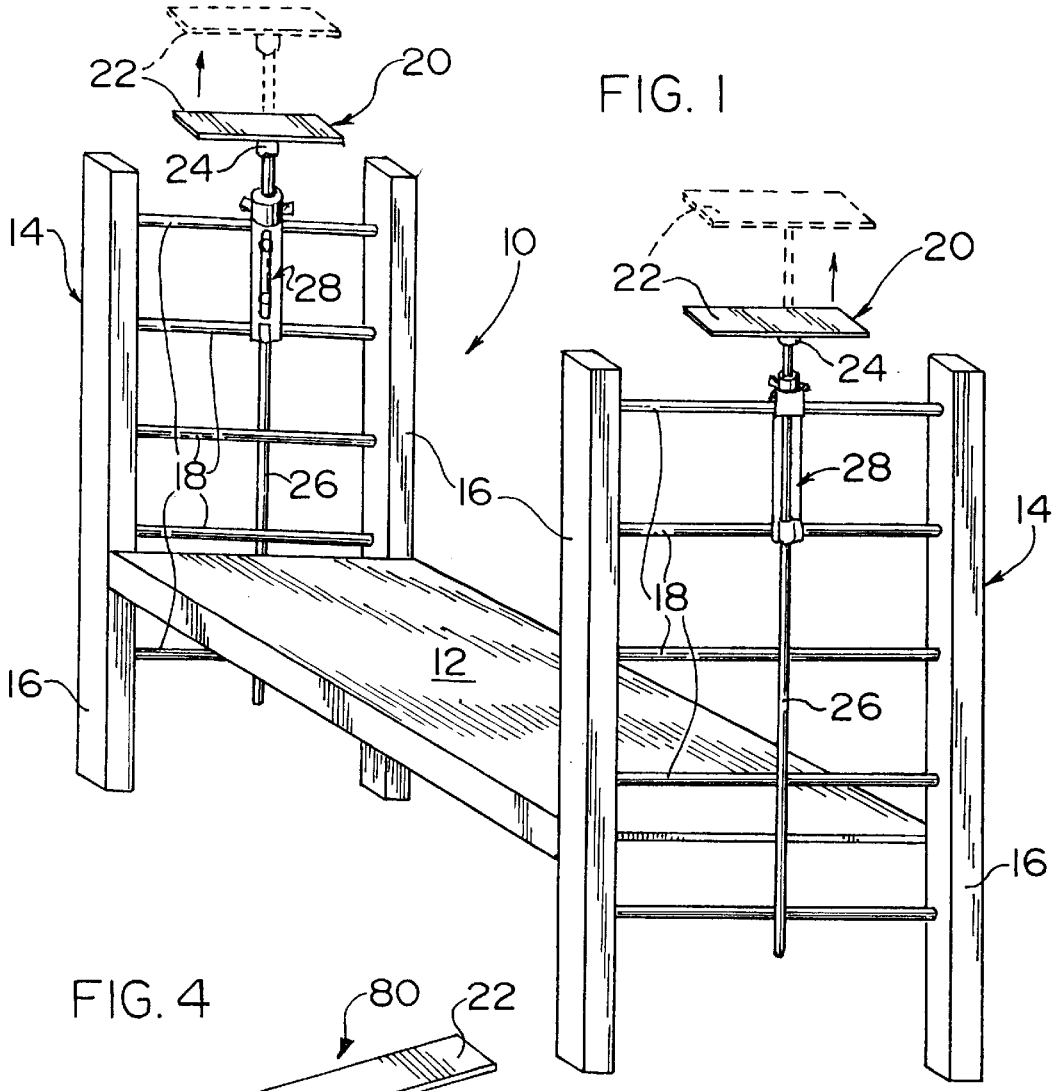
FIG. 1
FIG. 4
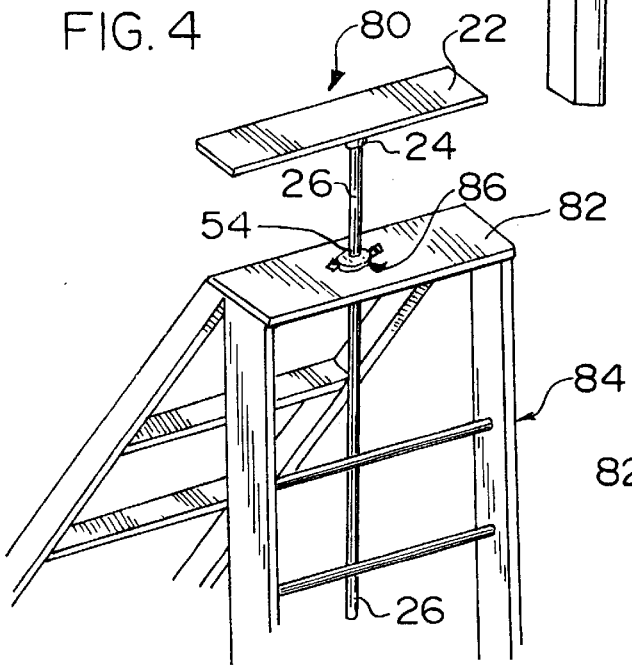
FIG. 5
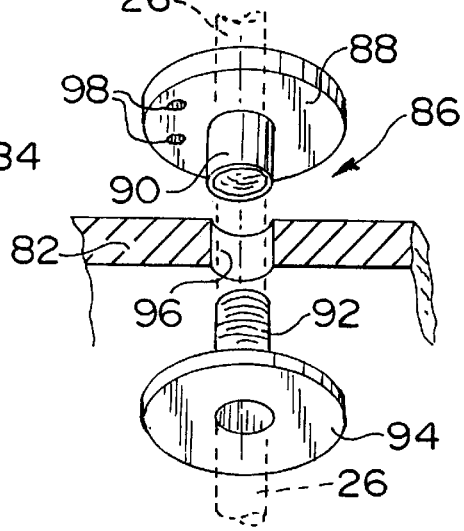

20
22
24
56
66
60
54
72
78
62
76
68
70
64
74
26
28
38
58
36
30
48
46
32
34
50
40
42
44
52

18

DEVICE FOR RAISING OBJECTS ABOVE ELEVATED WORK PLATFORMS

BACKGROUND OF THE INVENTION

A. Field of the Invention

This invention relates to devices for lifting and temporarily holding heavy and/or cumbersome objects to a desired level above a scaffold or ladder without straining the arms and backs of workers using these elevated work stations.

B. Description of the Prior Art

Current practice provides no assistance to scaffolders who are required to lift objects such as plasterboard panels weighing close to one hundred pounds each at arms' length above their heads and to hold the panels at that level for attachment. Many other building and maintenance operations requiring lifting heavy materials and supplies now make it necessary to expend great strength and energy while on elevated work stations. It is therefore the primary object of this invention to provide a device for raising materials and supplies at will to a desired level above the heads of workers operating the device on an elevated work station. It is also an object of this invention to provide a lifting device which is strong and durable, inexpensive to produce, simple, foolproof and significantly energy-saving to operate.

SUMMARY OF THE INVENTION

The lifting devices of this invention each comprise a horizontally disposed load platform mounted on a vertical pipe or pole. The pipe is held in vertical alignment by a guide member for slidable up-down movement therethrough, the guide member being part of a two-piece clamp assembly secured to the scaffold or stepladder on which the lifting device is being used. Mounted atop the clamp assembly and aligned with the guide member is a one-way locking element for controlling the platform-carrying pipe's up and down movement; when the platform is loaded and ready to be raised, the pipe can be pushed upwardly freely to a desired height but is automatically locked against slipping or moving downwardly; when the operator of the device chooses, he can press a manual lock-release to permit pipe and load platform to descend to a lower position for reloading.

Lifting devices of this invention may be used singly or, in the case of a scaffold, in pairs, one clamped on each end of the scaffold. In the latter instance, a single scaffolder can alternately push each pipe upwardly in incremental steps until the desired upper position of the load platforms is reached, while two operators on the scaffold can raise the load platforms simultaneously and in unison.

Full details of the structure and operation of the lifting devices of this invention will be disclosed hereinafter in connection with the accompanying illustrative, but not limiting, drawings, wherein:

BRIEF DESCRIPTION OF THE DRAWINGS

FIG. 1 is a top front right perspective view of a schematically shown scaffold with a lifting device of this invention mounted at each end thereof;

FIG. 4 is a partial top front left perspective view of a step-ladder having another embodiment of a lifting device of this invention mounted in operative position thereon; and FIG. 5 is an exploded bottom front perspective view of the clamp elements of the lifting device shown in FIG. 4.

DESCRIPTION OF THE PREFERRED EMBODIMENTS

Figures 2, 3:
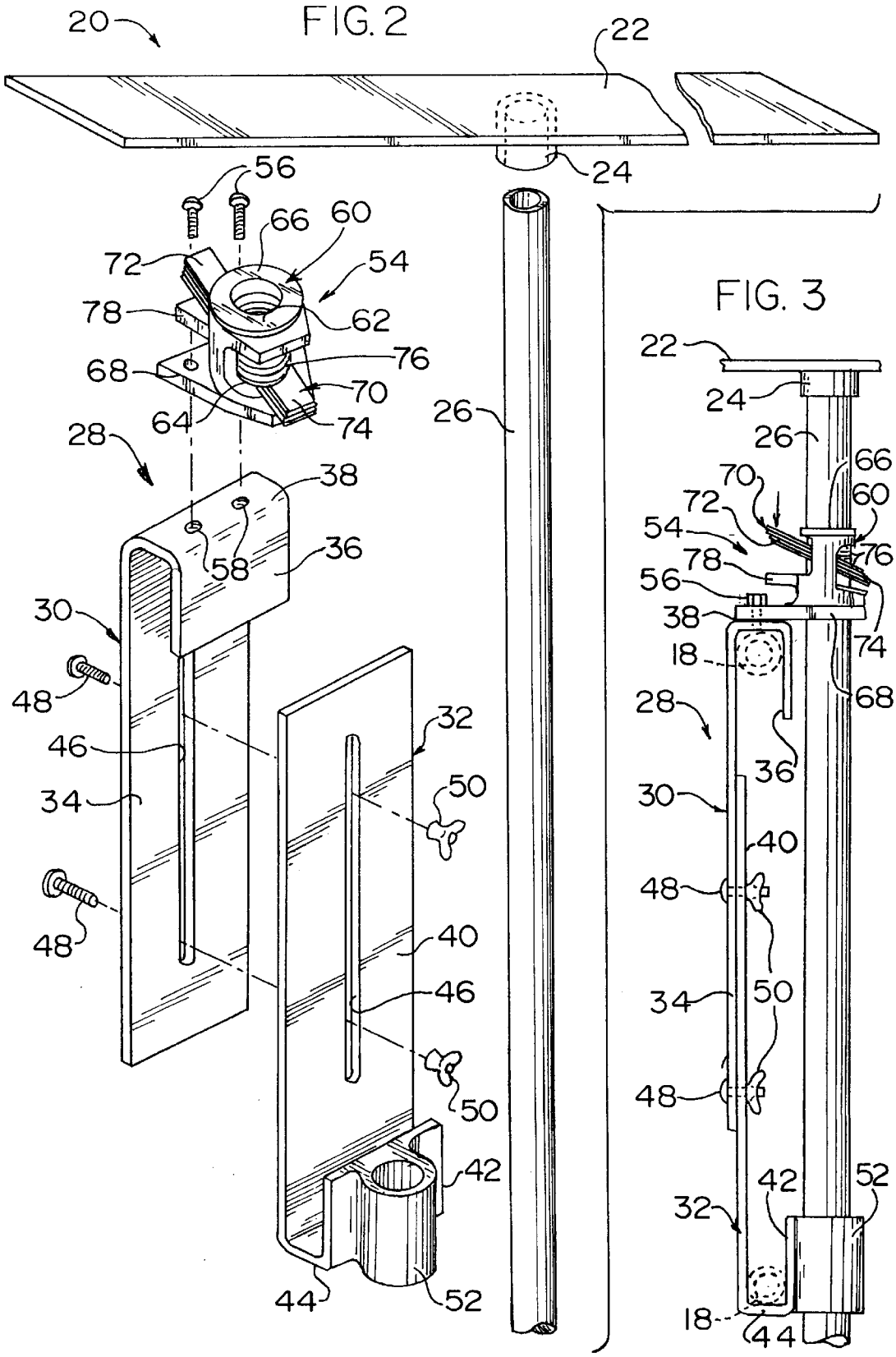
FIG. 2 is an exploded top front right perspective view of the components for one lifting device in accordance with this invention.
FIG. 3 is a side view of the components of the lifting device of FIG. 2 shown in FIG. 2 in assembled operative position.

Scaffold 10 shown schematically in FIG. 1 comprises floor or platform 12 attached at each end to a support structure 14. Each end structure 14 is made of two spaced vertical beams 16 positioned at the corners of platform 12, with vertically spaced horizontal crossbars 18 connecting beams 16.

A lifting device 20 of this invention is shown in FIG. 1 at each end of scaffold 10 clamped to two adjacent crossbars 18. Each device 20 has a load platform 22 with a centrally disposed downwardly extending nipple 24 threadedly connecting vertical pipe or pole 26 to load platform 22, these and other ensuing details of lifting device 20 being most clearly disclosed in FIGS. 2 and 3. Clamp assembly 28, which retains pipe 26 in position for vertical movement, comprises two substantially J-shaped clamp members 30, 32; upper clamp member 30, when assembled, is oriented as an inverted J, with its elongate side 34 and its substanially parallel short side 36 extending downwardly with connecting section 38 therebetween adapted to engage the surface of the upper of two selected scaffold crossbars 18, while lower clamp member 32, when assembled, is oriented as an upright J, with its elongate side 40 and its substantially parallel short side 42 extending upwardly with coonecting section 44 therebetween adapted to engage the surface of the lower of two selected scaffold crossbars 18. Each of the elongate sides 34, 40 of clamp members 30. 32 respectively has a centrally disposed vertical slot 46 extending most of the length of its side 34, 40. To install clamp assembly on scaffold 10, clamp members 30, 32 are placed so that elongate sides 34, 40 are in contact with each other and short sides 36, 42 face outwardly from scaffold 10, connecting sections 38, 44 are placed respectively around upper and lower scaffold crossbars 18 and pushed toward each other to obtain a snug fit, bolts 48 are passed through vertical slots 46 in both clamp members 30, 32 and wing nuts 50 are threadedly tightened on bolts 48 to lock clamp assembly 28 in operative position on scaffold 10.

Short side 42 of lower clamp member 32 has cylindrical pipe guide 52 welded to its outer surface. Guide 52's internal bore is dimensioned to permit platform-carrying pipe 26 to slide vertically up and down therein. Upper clamp member 30 carries on the upper surface of its connecting section 38 well-known one-way pipe lock 54, secured by fastening bolts 56 in threaded openings 58 of connecting section 38, and is positioned in vertical alignment with guide 52 so that pipe 26 passes therethrough. Pipe lock 54 comprises cylindrical housing 60 having cylindrical bores 62, 64 in upper and lower platforms 66, 68 thereof respectively for accommodating pipe 26 slidingly. Stacked multiple planar locking plates 70, cylindrically bored and pivotally mounted within housing 60 (not shown) have tabs 72, 74 extending from either end thereof. Plates 70 are biased angularly by strong spring 76 mounted within housing 60, so that pipe 26 can be moved upwardly through lock 54 at will to raise load platform 22 to any desired height; however, the angular position of the bores in locking plates 70 cause the inner surfaces thereof to engage the outer surface of pipe 26, preventing pipe 26 from slipping or moving downwardly. To release pipe 26 and bring load platform 22 down to its lowered position, the operator simply presses tabs 72 downward against spring 76, using projection 78 on housing 60 as a grip to assist in exerting pressure on tabs 72.

It may be noted that when scaffold 10 has a two-man team in place, each worker can operate one of the two lifting devices 20, and both load platforms 22 may be raised simultaneously by synchronized upward pushing of pipes 26; when a single worker mans scaffold 10, however, he can alternate pushing up pipes 26 incrementally until both load platforms 22 have been brought level at the desired height. In either case, the usefulness of the lifting devices 20 of this invention is exemplified by the raising and positioning of heavy plaster-board panels to be held up against ceiling beams while workers with free hands available can readily attach each panel in place with screws. It may also be noted that the shape, size and contour of load platforms 22 may be varied to suit the needs of a specific lifting operation.

Lifting device embodiment 80, illustrated in FIGS. 4 and 5 as mounted centrally on topmost step 82 of stepladder 84, operates identically to device 20 described above and utilizes the same load platform 22, threaded nipple 24 connecting pipe 26 thereto, and pipe lock 54. Two-piece clamp assembly 86 performs the same function as clamp assembly 28 described above, but differs in structure. Clamp assembly 86, best seen in FIG. 5, comprises upper cylindrical disk-shaped clampp member 88 having depending centrally disposed hollow cylindrical projection 90 internally threaded to accept fittingly upwardly projecting outwardly threaded hollow element 92 extending from lower cylindrical disk-shaped clamp member 94. When assembled, projection 90 of upper clamp member 88 passes fittingly through central bore 96 of step 82, element 92 is tightened within projection 90 to fix clamp assembly 86 in place to serve as a guide for tubular pipe 26 passing therethrough and a mounting platform for one-way pipe lock 54, to be attached on top of upper clamp member 88 at threaded openings 98 by bolts 56 (not shown in FIG. 5). The operation of lifting device 80 is identical to that of lifting device 20 described above.

The structural and operational details of the preferred embodiments of this invention, and the best modes now contemplated for its practice have been described. It will be apparent to those skilled in the art that various modifications, substitutions and equivalents may be used without departing from the concepts of this invention, which are defined and limited only by the scope of the ensuing claims, wherein:

What we claim is:

1. Device for raising objects to a selected height above an elevated work station, which comprises:

a horizontally disposed load platform for holding the objects to be raised thereon;

vertically disposed elongate tubular pipe means for supporting said load platform secured at the top thereof;

means for guiding said load-platform-carrying elongate pipe means for vertical movement therethrough;

adjustable clamping means for securing said device for raising objects to said elevated work station, said clamping means carrying said guiding means thereon and being selected from the group consisting of a clamping mechanism for extending between, being mounted on and firmly engaging two adjacent cross-bars at one end of a scaffold elevated work station, and a clamping mechanism for being mounted through a centrally disposed bore in the topmost step of a stepladder elevated work station; and one-way pipe-locking means mounted on said adjustable clamping means alignedly with said guide means, whereby said elongate pipe means passing therethrough is permitted to be moved in an upward direction when said load platform is being raised to a selected height, said one-way pipe-locking means having manually operated release means to allow lowering of said load platform and said elongate pipe means selectively.

2. Device for raising objects as defined in claim 1, wherein said elevated work station is a scaffold and said adjustable clamping mechanism mounted thereon comprises two substantially J-shaped clamp members, the longer arms of said J-shaped members being held together by more than one bolt passing through central elongate slots in each said longer arm for adjusting the effective length of said clamping means, each said bolt being secured in place by a wing nut, said two J-shaped clamp members being so oriented that their shorter arms are at opposite ends of said assembled clamp members and face each other, the connecting portion of each said J-shaped clamp member being hooked around and firmly engaging one of two adjacent cross-bars at one end of said scaffold.

3. Device for raising objects as defined in claim 2, wherein said means for guiding said elongate pipe means comprises a vertically oriented collar affixed to and extends outwardly from said shorter arm of the lower of said assembled J-shaped clamp members, said collar being dimensioned so that said elongate pipe means passes slidingly therethrough.

4. Device for raising objects as defined in claim 3, wherein said one-way pipe locking means is mounted on said connecting portion of the upper of said assembled J-shaped clamp members and the openings in said pipe locking means for accepting said elongate pipe means therethrough are aligned with said collar guiding means.

5. Device for raising objects as defined in claim 2, wherein said scaffold has one of said object-raising devices mounted at each end thereof to be operated in unison for raising large-dimension objects.

6. Device for raising objects as defined in claim 1, wherein said elevated work station is a stepladder and said adjustable clamping mechanism comprises two disk-shaped clamp members for mounting through a centrally disposed bore in the topmost step of said stepladder, the upper of said two disk-shaped clamp members having a central hollow internally-threaded projection extending downwardly and fittingly into said centrally disposed bore in said topmost step whereon said upper of said disk-shaped clamp members rests, the lower of said two disk-shaped clamp members having a central hollow externally-threaded projection extending upwardly to threadedly engage said downwardly extending projection and to tighten said lower disk-shaped clamp member securely agaist the bottom of said topmost step, whereby said hollow threadedly connected projections serve as a guide for said elongate pipe means therein.

7. Device for raising objects as defined in claim 6, wherein said one-way pipe locking means is mounted on op of said upper disk-shaped clamp member and the openings in said pipe locking means for accepting said elongate pipe means therethrough are aligned with said hollow threadedly connected projections.

8. In combination with a one-way tubular pipe lock, a device for raising objects to a selected height above an elevated work station, which comprises:

a horizontally disposed load platform for holding the objects to be raised thereon;

vertically disposed elongate tubular pipe means for supporting said load platform secured to the top thereof;

means for guiding said load-platform-carrying elongate pipe means for vertical movement therethrough; and adjustable clamping means for securing said device for raising objects to said elevated work station, said clamping means carrying both said guiding means and said one-way tubular pipe lock means, said clamping means being selected from the group consisting of a clamping mechanism for extending between, being mounted on and firmly engaging two adjacent cross-bars at one end of a scaffold elevated work station, and a clamping mechanism for being mounted through a centrally disposed bore in the topmost step of a step-ladder elevated work station.

* * * * *